United States Patent [19]

Oberholzer

[11] 4,429,298

[45] Jan. 31, 1984

[54] METHODS OF TRIMMING FILM RESISTORS

[75] Inventor: David J. Oberholzer, Bethlehem, Pa.

[73] Assignee: Western Electric Co., Inc., New York, N.Y.

[21] Appl. No.: 350,658

[22] Filed: Feb. 22, 1982

[51] Int. Cl.[3] ..... H01C 10/00

[52] U.S. Cl. ..... 338/195; 29/620; 338/308

[58] Field of Search ..... 338/195, 308, 309; 219/121 LH, 121 LJ; 29/593, 620

[56] References Cited

U.S. PATENT DOCUMENTS

| | | | |
|---|---|---|---|
| 3,821,845 | 7/1974 | Hukee et al. | 29/593 |
| 3,889,223 | 6/1975 | Sella et al. | 338/195 |
| 3,916,142 | 10/1975 | Ennis | 338/195 X |
| 4,032,881 | 6/1977 | Singleton | 338/195 |
| 4,149,064 | 4/1979 | Houska et al. | 29/620 |
| 4,242,152 | 12/1980 | Stone | 219/121 LJ X |
| 4,352,005 | 9/1982 | Evans et al. | 338/195 X |

OTHER PUBLICATIONS

R. L. Brown, *IBM Technical Disclosure Bulletin,* "Cermet Resistor Trimming", vol. 22, No. 3, Aug. 1979, p. 956.

*Primary Examiner*—C. L. Albritton
*Attorney, Agent, or Firm*—W. O. Schellin

[57] ABSTRACT

A bar-type film resistor (40) is adjusted to a high degree of precision by longitudinally offset plunge cuts (41, 42 and 43) extending from alternately opposite edges (29, 49) into the resistive layer (13), by a trim cut (46) which extends from the most recently made plunge cut (43) longitudinally through the resistor (40), and by a shave cut (47) which is coextensive with the trim cut and preferably overlapping therewith. The trim cut (46) and any shave cut (47) are located at a predetermined distance from a reference edge (29). The most recently completed plunge cut extends from its starting edge (29) into the resistive layer (13) to distances greater than those at which the trim cut and the shave cut are to be located.

8 Claims, 6 Drawing Figures

METHODS OF TRIMMING FILM RESISTORS

TECHNICAL FIELD

This invention relates to methods of trimming film resistors and to a resistor trimmed by such methods. The invention is particularly useful for trimming bar type film resistors to a specified value when a high degree of precision is desired. As it will become apparent from the further description of the invention, the advantages of the invention apply, for example, to thick film resistors as well as to thin film resistors. Thus, while the description of a preferred embodiment of the invention makes reference to specific materials, dimensions and resistive values of thin film resistors, it is to be noted that the described features of the invention apply to film resistors in general.

BACKGROUND OF THE INVENTION

A bar resistor is typically formed by a rectangular, resistive layer which is deposited on an insulating substrate and is contacted on each of two opposite edges by a conductive terminal. The resistive value of such a resistor depends on the surface geometry of the resistive layer between its two terminals, and on the resistivity of the layer, such resistivity being typically characterized in ohms per square unit of film area, which is simply designated as ohms per square.

Because of variations in the resistivity of the resistive layers, bar resistors, by design, typically are formed to have values well below the desired values of the resistors. The desired values of the resistors are thereafter attained by altering the straight electrical paths through the resistive layers between the terminals. The process of altering the resistors is known as resistor trimming.

The electric paths between the terminals are typically altered by one or both of two different, yet related techniques. By one technique, a path is simply narrowed, such that, in relation to its width, the path is lengthened whereby its resistance is increased. According to a second technique, staggered cuts are made into alternately opposite edges of a resistive layer to change an originally straight electrical path into a serpentine path. These cuts, referred to as plunge cuts, also lengthen the electrical path between the terminals of the respective resistor and, hence, raise its resistance.

The state of the art for making such resistor trim cuts is well advanced to the extent that commercially available systems using laser energy for the trim cuts typically use commercially available mini or micro computers to direct the laser cutting operations. Such commercially available systems as, for example, one available from Teradyne, Inc. permit laser cuts to continue for predetermined distances, using coordinate inputs, or to stop a cut when a resistor which is being trimmed reaches a certain resistive value. A resistance bridge circuit is used for measuring the resistance of the resistor being trimmed. Typically the measurement is not continuous but is made between laser pulses in discrete measuring steps at the pulse rate of the laser.

An existing control program furnished with such a commercially available system also permits the laser cut to be redirected to continue from the end of a first cut with a second cut at right angles to the first cut, when such first cut has reached a preset value. This latter program therefore permits a combination of a plunge cut and a longitudinal cut as a final trim cut.

The cuts are terminated when the preset position of the laser is reached, or as soon as the resistance bridge indicates that a desired value is reached, the next subsequent laser pulse is inhibited.

In spite of the availability of the described automated trimming apparatus, it has nevertheless been difficult to trim film resistors to value with a high degree of precision. For example, when trimmed resistor values are required to fall within a tolerance range of plus or minus one-tenth of one percent, typical resistor trim techniques were found too inaccurate to be used at reasonably economical speeds. A technique for trimming resistors at reasonable speeds and to a relatively high degree of accuracy is, therefore, desirable.

SUMMARY OF THE INVENTION

In accordance with the invention, an improved technique for precision trimming film resistors involves a combination of first plunge cuts and second longitudinal trim cuts at right angles to such plunge cuts, wherein such plunge cuts extend from alternately opposite edges by a predetermined distance through the width of a resistor to be trimmed, such predetermined distance being bounded by preset minimum and maximum values, and a longitudinal trim cut originates from a last formed plunge cut at a distance less than the minimum value from the edge at which the last plunge cut originated.

BRIEF DESCRIPTION OF THE DRAWING

The following detailed description of the invention and of a preferred embodiment thereof will be best understood when read in reference to the accompanying drawing, wherein.

DETAILED DESCRIPTION

General Considerations

Figure 1:
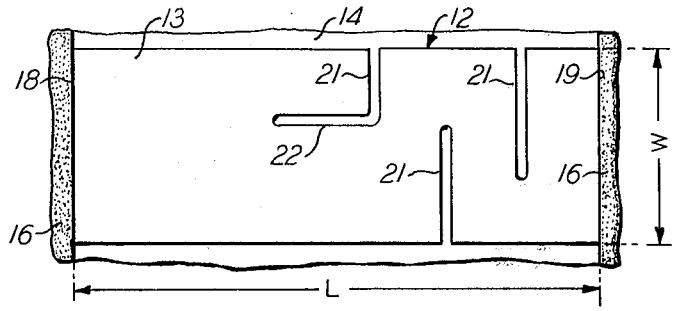
FIG.-1 (PRIOR ART)
FIG. 1 is a top view of a typical film bar resistor, said resistor displaying typical prior art plunge cuts and a prior art trim cut.

Referring now to FIG. 1, there is depicted a typical bar resistor 12 of a desired width W and a length L which is formed as a layer 13 of material of a desired resistivity on an insulating substrate 14. Conductive terminals 16 bound two opposite edges 18 and 19 of the resistor 12. The spacing between the edges 18 and 19 defines the length L of the resistor 12.

In a typical example where the bar resistor 12 is a thin film resistor, the resistive layer may be tantalum nitride which is deposited to a typical thickness in the range of 400 Angstrom units. Such a thickness may yield a theoretical resistivity of, for example, 300 ohms per square. In the example of the thin film resistor 12, the conductive terminals may be formed of gold. The resistor may, for example, have a length L of 48 mils and a width W of 12 mils, 1 mil being one one-thousandth of an inch or $25.4\times10^{-6}$ meters. The nominal resistance of the untrimmed resistor 12 amounts, consequently to 4 squares of 12 mils multiplied by the nominal sheet resistance per square, or 1200 ohms. However, since the sheet resistance of the resistive film may vary, for example, between 200 and 400 ohms per square, the untrimmed resistance of the bar resistor 12 is likely to be anywhere between 800 and 1600 ohms.

The ultimately desired resistance of a resistor for which the untrimmed bar resistor 12 is therefore desirably in the range of 2000 ohms or greater, the increase in resistance being achieved by plunge cuts 21, where the last of such plunge cuts 21 is typically terminated with a right-angle longitudinal fine trim cut 22. Such longitudinal fine trim cut 22 is started according to a prior art technique as a continuation of the current plunge cut 21 when the resistor has reached a predetermined percentage value of its desired, final value. While such known trimming technique yields, in most instances, resistor values with reasonable tolerances, it does occur that the final values of resistors show, on occasion, undesirable variations from the desired value and its specified tolerance.

Figure 2:
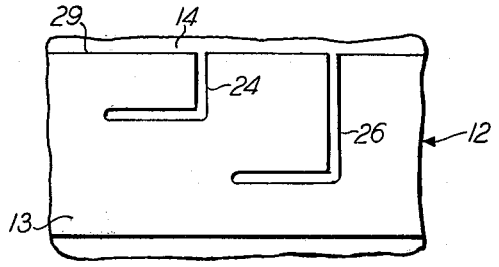
FIG.-2 (PRIOR ART)
FIG. 2 is a top view of a portion of a typical bar resistor of FIG. 1, showing a plurality of final plunge cuts, each featuring a typical longitudinal trim cut made in accordance with prior art techniques.
Figure 3:
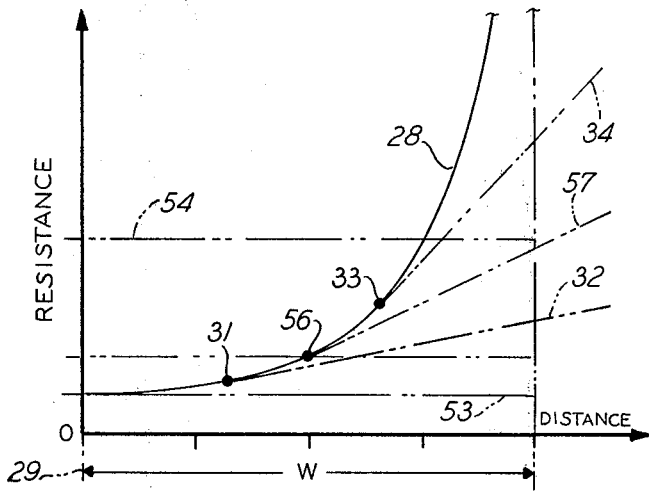
FIG. 3 is a diagram showing a relationship between the resistance of the bar resistor and the plunge and trim cuts such as those shown in FIG. 2.

In reference to FIGS. 2 and 3, variations in tolerance levels can be explained. FIG. 2 shows two typical prior art plunge and fine trim cuts 24 and 26. Normally only one of such right angle cuts would be made on any one bar resistor, however, the cuts 24 and 26 are shown on the same bar resistor 12 to point to a problem in prior art adjustment techniques.

The cut 24 has proceeded a shorter distance into the bar resistor 12 than the cut 26 when a preset value is reached which initiates the fine trim cut in the longitudinal direction of the resistor 12. For example, the longitudinal leg of the cut 24 may start at a distance of one third of the width of the resistor 12 while the similar leg of the cut 26 may start at a distance of two thirds of the width of the resistor 12.

FIG. 3 shows a graph 28 showing a non-linear relationship between the resistance of the resistor 12 and the depth of a plunge cut. The change of the resistance plunge cut increases as the depth of the increases, the resistance becoming infinite as the plunge cut reaches the width of the bar. If at any one depth the plunge cut is changed to a longitudinal cut, however, the resistance changes substantially linearly from that point on.

Investigations have shown that the rate of change of the resistance of such longitudinal cut depends on the distance from the edge 29 of the beginning of the plunge cut, at which the longitudinal cut is started. The rate of change of such longitudinal cut is such that a graph representing such change is tangential to the graph 28 at a point at which the longitudinal cut is started.

Thus in FIG. 3, point 31 on the graph 28 represents the knee of the cut 24 in FIG. 2. Point 31 is located approximately one third of the total width W from the reference edge 29. The dashed line 32, consequently, represents the resistance change of the bar resistor 12 relative to any increase in the length of the cut 24. Point 33 on the graph 28 correspondingly represents the location of the knee in the cut 26. (see FIG. 2) at approximately two thirds of the width from the reference edge 29. Dashed line graph 34 shows the rate of change of the resistance of the resistor 12 relative to any increase in the length of the longitudinal leg of the cut 26.

By approximating the respective slopes of the line graphs 32 and 34, it is readily seen that the slope of the line graph 34 is at least three times as great as that of the line graph 32. The respective tolerances of the fine trim lines of the cuts 24 and 26 vary accordingly. The methods of trimming as further described herein alleviate such inconsistencies in the tolerances of the final resistor trim cuts.

Improved Trimming

Figure 4:
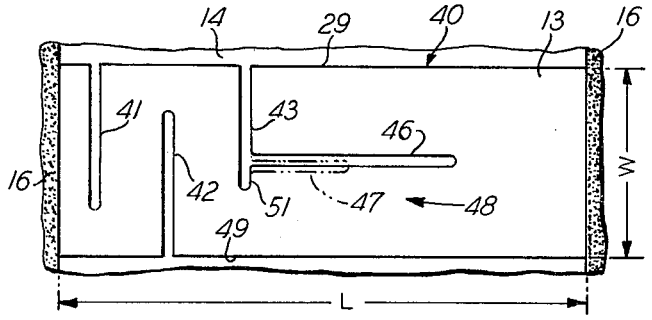
FIG. 4 is a bar resistor such as the one shown in FIG. 1, which has been trimmed in accordance with the present invention.

FIG. 4 depicts a bar resistor, identified by numeral 40, which is distinguished from the resistor 12 shown in FIG. 1 through the method by which it has been trimmed and through the location of the trim cuts of the resistor. The untrimmed structure such as the resistive layer 13 formed on the insulating substrate 14 and the spaced terminals 16 may be identical in composition and size to the resistor 12 in FIG. 1.

The resistor 40 shows, in summary, three types of trim cuts. A first type of cut is represented by plunge cuts 41, 42 and 43, the plunge cut 43 being the most recent and final one. The final plunge cut 43 is followed by a fine trim cut 46 which extends longitudinally through the resistive layer and parallel to the reference edge 29. A third type of cut is a shave cut 47 (shown in phantom lines), extending parallel and in overlapping relationship to the fine trim cut 46 to reduce by a deliberately small amount the width of a resistive area 48 between the fine trim cut 46 and an adjacent edge 49 of the resistor 40. While the plunge cuts 41, 42 and 43, the fine trim cut 46 and the shave cut 47 are all trim cuts, for clarity they will be referred to as plunge cuts, trim cuts and shave cuts, respectively.

In distinction to plunge cuts and trim cuts made in accordance with the prior art, the lengths of the plunge cuts 41, 42 and 43 are controlled within limits and the trim cut 46 is established in a predetermined position measured from one longitudinal edge of the resistive layer independently of how far the final plunge cut extends past such position. For example, in a preferred embodiment of the invention the length of each plunge cut including that of the final plunge cut 43 limited at the high end to a length of 75% of the width W of the resistive layer 13. All plunge cuts except for the final plunge cut 43 necessarily extend three quarters of the width W through the resistor 40.

The final plunge cut 43 is also limited not to exceed 75% of the width W of the resistor 40, but meets one additional constraint in that its length is to be greater than a predetermined minimum value. The predetermined minimum value assures continuity between the plunge cut 43 and the trim cut 46. In addition to the physical continuity between the two cuts, it is desirable that the trim cut 46 does not originate from the tip of the last plunge cut 43, as shown by the positional relationship between the cuts 21 and 22 of the resistor 12 in FIG. 1. An appendix 51, as shown in FIG. 4, extending past the position of the trim cut 46 has been found to be advantageous in that it tends to avoid adjustment errors when the final plunge cut 43 advances the adjusted resistor value close to its desired value.

In the preferred embodiment, the trim cut 46 is chosen to be located on the centerline of the width W of the resistor 40. Consequently, the final plunge cut 43 preferably extends more than half way through the width W of the resistor 40. Referring back to the graph 28 of FIG. 3, it has been verified experimentally, that substantially 25% of the total resistance change as a result of a plunge cut to 75% of the width W (between an original value level 53, and a final value level 54)

occurs when the cut extends through one half of the width W.

To ensure that the last plunge cut 43, from which the trim cut 46 is thereafter originated, extends by at least some distance past the centerline of the resistor 40, the length of the plunge cut is chosen to result in at least one third of the anticipated change in resistance of a plunge cut extending to 75% of the width W of the resistor 40. The trim cut 46 is then originated from a point 56 on the graph 28. The effect of the trim cut 46 on the resistance of the resistor 40 is in essence identified by the line graph 57.

Since the trim cut 46 in the final adjustment of any resistor made according to the described method, is typically originated at the same distance from the edge 49, the rate of adjustment of the resistor with respect to each advance of the laser cut yields in each case a value within a predictable tolerance.

The length of the appendix 51, extending into the area 48, may in a limiting case be negligible, yet its presence typically avoids a sudden increase of, and attenuates the rate of change in, resistance caused by the first or the first few laser pulses made on the trim cut 46. Referring to FIG. 4, it is seen that any cutting pulse which narrows the width of the resistive layer between the tip of the appendix 51 and the edge 49 changes the resistance of the resistor 40 substantially. The line graph 57 in FIG. 3 may, consequently, show an initial shallow slope which approaches the line 57.

The shave cut 47 is an overlapping cut made parallel to the trim cut 46. A typical width of the path of the laser cut is 1 mil to 1.2 mil. A preferred lateral offset for the shave cut 47 is, for example, 0.5 mil. Of course, the precision of the shave cut 47 is greater, when it is possible to start the cut under the attenuating influence of the appendix 51 of the final plunge cut.

Figure 5:
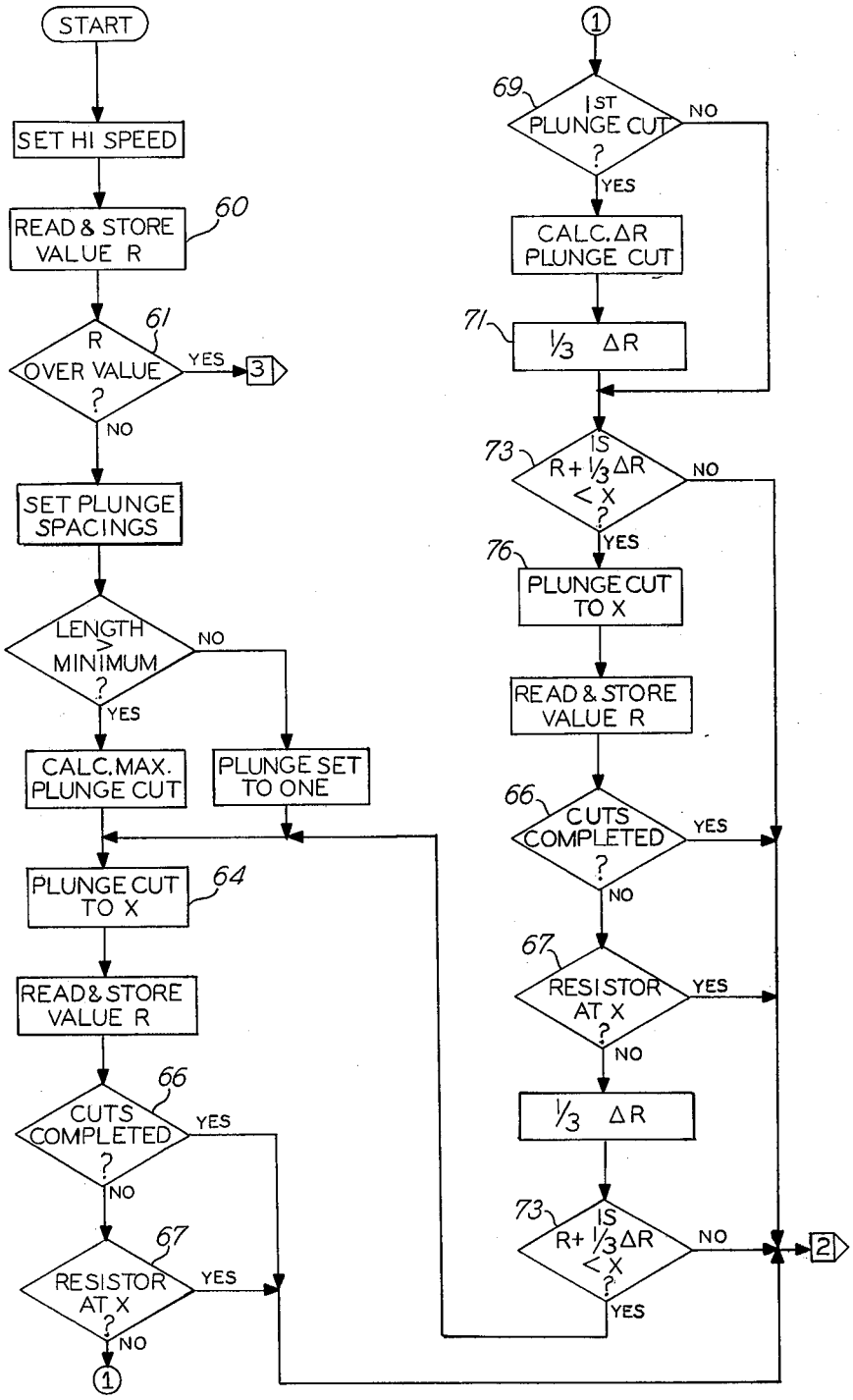
FIGS. 5 and 6 show a flow diagram of a preferred trimming technique in accordance with the invention.
Figure 6:
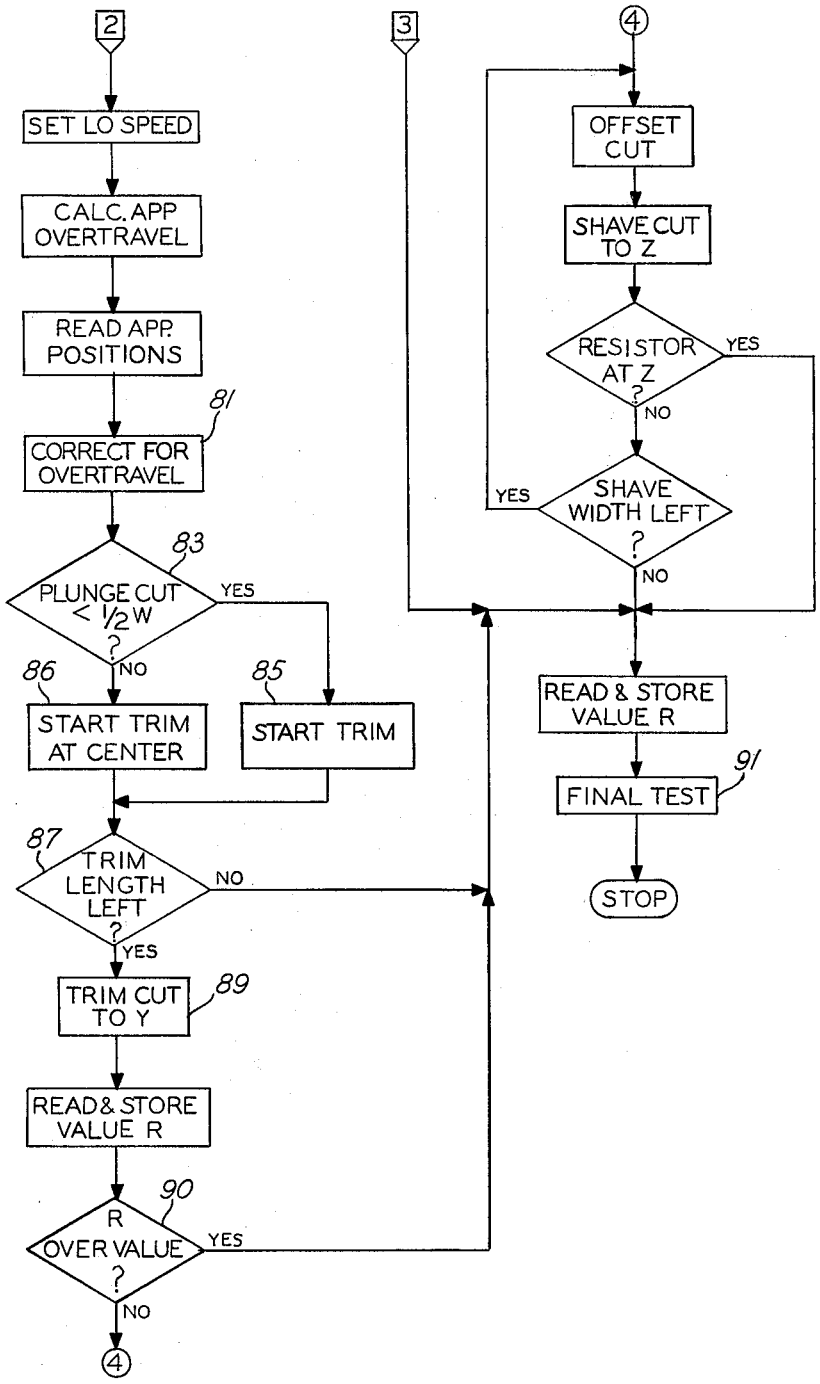

While the invention and its advantages have been described with respect to the resistor 40 of FIG. 4, various advantages of the invention may be better understood from a flow chart shown in FIGS. 5 and 6. In following the further description, a reference to the flow chart and to the resistor 40 in FIG. 4 may be helpful.

A Preferred Trim Sequence

The plunge cuts are best performed at a high cutting rate or speed. One mil advances per pulse for a cutting diameter of about 1.2 mils constitute a preferred high speed setting of a typical commercially available, such as one from Teradyne, Inc. In such system (not shown), the position of the laser impingement is, for example, controlled by rotatable mirrors. The mirrors are typically driven by galvanometers. While these galvanometer and mirror combinations have little mass, a small amount of overdrive and consequent inaccuracy is, nevertheless, present. Other commercial systems use index tables to move the work (the resistor 40) with respect to the laser beam. Even though particularly described with respect to such mirror-controlled apparatus, the steps and considerations herein are believed to be useful for trimming resistors in accordance with this invention independent of the cutting system which may be preferred.

The high speed is preferred for the plunge cuts 41, 42 and 43 as indicated. The value of the resistor 40 prior to trimming is read and stored as indicated by step 60. Then the value is compared to the desired value to test whether it is equal to the desired value or greater than the desired value. If the value is equal to or greater than the desired value of the resistor 40, no adjustment can be made, in that any trimming operation on the resistor 40 would further increase its resistance. When an overvalue is detected, the process branches immediately to the final testing steps in FIG. 6. The test identified by the numeral 61 is referred to as overvalue test.

Continuing with the process in FIG. 5, a preferred spacing between adjacent plunge cuts is set. Variations herein are largely a matter of choice. The spacing, which is typically expressed in center-to-center distances of adjacent cuts depends on the current carrying requirements for the resistor, on the type of resistive film, on the resistivity and various other factors which may be deemed significant. It is known that in making plunge cuts, the first cut may be spaced closer to the adjacent electrode than the spacing between subsequent cuts without imbalance on the current carrying capability of the resulting resistor. Such a reduced spacing to the terminal 16 is shown, for example, in the position of the plunge cut 41 in FIG. 4.

The length of the resistor 40 is now compared to a minimum length value to determine whether one or more plunge cuts can be accepted. Such minimum length is a matter of design criteria. However, the minimum length of the resistor should permit one plunge cut and a trim cut 46 located at a predetermined position relative to the longitudinal edges 29 and 49 to arrive at the desired final value of the resistor 40.

If the test shows a length L less than the desired minimum value, the number of plunge cuts are set to one. If the length of the resistor 40 exceeds the minimum value, the maximum number of plunge cuts is established, leaving, for example, a minimum of 1.5 squares as the final adjustment area 48 adjacent to the trim cut 46.

A plunge cut is then made toward reaching a resistor value no greater than a value X as identified by the step 64. The value X is preset in the trim system to represent a first tolerance value of the desired resistance value less, for example, 8%. Upon completion of the cut, the new value R of the resistor 40 is read and stored. Thereafter, a test 66 is made to determine whether the maximum allowable number of plunge cuts have been made. If the test shows that the maximum number of allowed cuts have been completed, the trim cut 46 is started, whether or not the value X has been reached, since no more plunge cuts are allowed. The process, in that event, branches to FIG. 6. If, however, the length L permits more plunge cuts to be made, a test 67 checks whether the value X has been reached. If the just completed plunge cut brought the value of the resistor 40 to the value X, namely to the predetermined percentage value below the final desired value, then the trim cut 46 can be started, even though the remaining resistor length L permits additional plunge cuts.

If the value X has not been reached, additional plunge cuts may be necessary, unless, significantly, an additional plunge cut to bring the value of the resistor 40 to the value X would have a length less than the minimum desired length to permit the trim cut to be originated at the predetermined distance from the reference edge, as, in the preferred example, along the center of the resistor 40.

It therefore becomes necessary to know, or to be able to reasonably estimate, the length of the next plunge cut, to determine whether the next plunge cut should be made. It has been found experimentally that for given plunge cut spacings and predetermined maximum lengths, a relationship of resistance changes due to the first and any subsequent plunge cuts can be established with reasonable accuracy. The change in resistance due to the first plunge cut 41 need not be the same as the change of resistance due to the second or any subsequent plunge cuts 42. However, all subsequent plunge cuts made to the predetermined depth (of three fourths of the width W in the preferred example) result in substantially equal increments of change in the resistance.

In the preferred example where the width of a tantalum nitride resistive film is 12 mils, the preferred maximum length of each plunge cut is consequently 9 mils, such that a resistive gap of about three mils in width and about one mil in length (established by the width of the cut) is formed. If the spacing of subsequent plunge cuts 42 is such that a resistive area of about one square is formed by the overlapping portions of adjacent plunge cuts, then the resistance change of subsequent plunge cuts can be determined to be approximately 2.5 times the change in resistance due to the first plunge cut.

Consequently, a test 69 queries whether the last completed plunge cut was, in fact, the first plunge cut 41. If the first plunge cut 41 has just been made, a "Delta R" for the next full cut is calculated by estimation based on topology and preferably on prior experimentation. One third of that value is then calculated as shown in step 71 of the flow chart. Since one fourth of the change in resistance of a full cut has been determined by similar experimentation to occur when the plunge cut 42 has advanced one half of the distance through the width W of the resistor 40, one third of the expected change represents a cut past the center of the resistor.

A test 73 consequently queries whether the present value R of the resistor 40, namely the value after the latest cutting operation added to the predicted value "Delta R" is still less than the value X. If the sum of the two values $R+\Delta R$ is equal to or greater than the value X, the next plunge cut will not be started and the trim cut is the next cut, even though the desired first approximation value of X ohms was never reached by the plunge cuts.

By this premature departure from the first type or primary adjustment procedure to the first approximate value X, a more consistent adjustment procedure by the second type cut, namely the trim cut 46 is provided for.

If the test 69 indicates the just completed plunge cut not to be a first plunge cut 41 but instead a subsequent cut 42, then the value "Delta R" need not be estimated but is available from the difference in values R read after such latest plunge cut and the last value R from before such cut was made. These values are determined from the read and stored values R. The process can therefore proceed directly to the determination or test 73 of whether the next cut will be a further plunge cut. In this latter instance, one third of the actual change caused by the previous plunge cut is used by the test 73.

If the outcome of the test 73 shows that another plunge cut is to be made to raise the resistance toward the value X, the cut is made as shown by the step 76 in the flow chart of FIG. 5 and the newly reached resistor value R is read and stored, as after each cutting operation. The cutting operation 76 is further followed by the "cuts completed" test 66, by the "resistor at X" test 67 and by the test 73 to determine whether the next plunge cut should be started, even though the first approximation value X has not yet been reached. In this last test 73 and in any subsequent tests 73, the "Delta R" value is the change caused by the most recent plunge cut.

Once it has been determined from the tests 66, 67 or 73 that no further plunge cut is to be made, preparations for the trim cut 46 are made as shown in the continuation of the flow chart in FIG. 6. As an initial preparation for making the trim cut 46, the incremental advance speed of the laser, namely the distance between pulses is reduced. In the preferred embodiment, wherein the diameter of a laser burn on the tantalum nitride film amounts to about 1.2 mil, the incremental advance speed is set from the initial, preferred 1 mil to a more precise, slower advance speed of 0.75 mil per pulse.

The overtravel of the mirrors controlling the laser impingement is then estimated from the last pulsed position of the final plunge cut. The overtravel of the laser positioning mechanism depends to a large extent on inertia and should therefore be determined or verified for each system or apparatus. For a laser trim apparatus sold by Teradyne, Inc., the overtravel was experimentally determined to satisfy an equation, wherein the overtravel is determined in terms of 0.5 mil increments which are the smallest incremental movements to which the control system of such apparatus is adjustable.

As expressed in such increments, the overtravel (OT) is estimated by:

$$OT = \frac{QRT}{4} \cdot (1 + DBS)$$

where QRT is the pulse frequency (in kilohertz) of the laser apparatus and DBS is a bite number which is furnished with the apparatus, and which together with the pulse frequency of the laser, determines a bite increment of a given depth for a given pulse frequency of the laser. However, the above equation may not be accurate for all laser trim apparatus even of the same type, since the inertia of the mirrors may vary from apparatus to apparatus.

Continuing with the process, the actual apparatus position of the mirrors controlling the laser impingement position is then read from the galvanometer and a correction is made to correct such position for the amount of overtravel since the last laser pulse, such correction being indicated by step 81 in FIG. 6.

A test 83 now checks whether the last plunge cut in fact extended past one half of the width W of the resistor 40. Even though the last plunge cut would not have been started, had the final plunge cut been calculated to be less than one half of the width W long, an imperfection, for example, in the resistive layer may have caused the value X to have been reached prematurely. Test 83 guards against such possibility. If the final plunge cut is, in fact, less than one half of the width W, the trim cut 46, as an exception, is started from a position not in the center of the resistor 40. However, the starting position of the trim cuts backed up from the tip of the final plunge cut 43 by two mils to provide for the appendix 51 in starting the trim cut 46 as shown by the step 85. Such backup is believed to afford a sufficient margin to assure continuity between the final plunge cut 43 and the trim cut 46. The resulting appendix 51 further provides at least for one or two initial pulses only a slight increase in resistance to prevent an accidental overadjustment at the very beginning of the trim cut 46. It should be noted that a short final plunge cut to necessitate this last described departure from positioning the trim cut in the center of the resistor 40, may also occur where the first plunge cut 41 reaches the value X.

Typically, however, the final plunge cut has a length which is greater than one half of the width W of the resistor 40 but less than three quarters of such width, such that the trim cut 46 can be started on the centerline between the edges 29 and 49 of the resistor 40. The step 86 positions the laser beam to start the trim cut 46 at such center.

A length test 87 checks whether there is sufficient length left on the resistor to perform the desired trim cut 46. A second value Y is now taken into consideration to which the trim cut 46 seeks to adjust the resistor 40. The value Y is less than the final desired value by only a small amount. For example, the value Y may be set as the final value less 0.1% thereof. The trim cut 46 is now initiated as indicated by the step 89. After each cutting pulse, as it is typical for the apparatus, a determination of the value of the resistor 40 is made and the cut is discontinued when the target value, in this instance the value Y, is reached. The attained value R is again read and stored.

The resistor 40 is now checked by test 90 if its value exceeds the value Y. If the value is exceeded, which is possible because of apparatus tolerances or film resistivity variations, it satisfies the desired tolerance, at least from the low-resistance end and a final test is performed as indicated by step 91. If the resistor value R lies on the border of the desired tolerance, the shave cut 47 is now made as shown by step 92. The value Z for the shave cut is preferably set for the precise value which is desired for the resistor 40. Thus, at the end of the shave cut 47, the value R of the resistor 40 is typically well within the 0.1% tolerance of the desired value Z.

The described process has been found to generate precision trimmed thin film resistors. However, the described methods are applicable to trimming or adjusting other film resistors which are formed by resistive layers of reasonably uniform resistivity per square. Even when the resistivity is not as uniform as desired to trim a resistor to within 0.1% of its nominal value, the described methods are still valid to trim resistors to substantially uniform resistance values within a reasonably broader tolerance range.

The above-described typical embodiment of the invention is but one specific example set forth for illustrating and teaching various features and advantages of the invention. It should be understood that various changes and modifications are possible without departing from the spirit and scope of the invention.

What is claimed is:

1. A method of trimming a film resistor having a rectangular resistive layer bounded laterally by spaced reference edges extending generally in the direction of an intended current flow through said resistor, the method comprising:

progressively cutting into the resistive layer, thereby forming at least one plunge cut commencing at one of said spaced reference edges and extending toward the other;

monitoring the resistance, and any change therein, of said resistor while forming said at least one plunge cut;

terminating said cutting to form said at least one plunge cut at a first predetermined distance from said one reference edge, unless a first predetermined target resistance value is detected by said monitoring step prior to said at least one plunge cut progressing to said first predetermined distance, and in the event of said monitoring step detecting said first predetermined target resistance, terminating said progressively cutting into said resistive layer with said at least one plunge cut; thereafter progressively cutting the resistive layer with a trim cut originating at said at least one plunge cut which is most recently formed and proceeding in a direction parallel to said spaced reference edges and at a second predetermined distance from said one of said spaced reference edges, said second predetermined distance being less than the distance to which said most recently formed of said at least one plunge cut extends into said resistive layer; and terminating progressively cutting the resistive layer with said trim cut upon said resistor reaching a second predetermined target resistance.

2. A method of trimming a film resistor according to claim 1, wherein at least one plunge cut is terminated at said first predetermined distance into said resistive layer, and the resistance of said resistor is less than said first predetermined target resistance, said method further comprising:

determining from a resistance change in the resistor due to the most recently formed one of said at least one plunge cut the length of a subsequent plunge cut required to change the resistance of the resistor to said first predetermined target resistance; and progressively cutting the resistive layer with said trim cut originating from said most recently formed one of said at least one plunge cut upon determining said length of said subsequent plunge cut be no greater than said second predetermined distance.

3. A method of trimming a film resistor including a substantially rectangular resistive film layer, comprising:

making at least one plunge cut adjacent to one end of resistive film layer, starting at one lateral edge of such layer and progressively extending such at least one plunge cut toward an opposite lateral edge thereof, and starting each of any subsequent plunge cuts at a predetermined spacing in the longitudinal direction of the resistor from any most recently completed plunge cut and extending any such subsequent plunge cut in the opposite direction to such most recently completed plunge cut, starting from the edge opposite to the one edge from which said most recently completed plunge cut was started;

terminating making such at least one plunge cut upon the resistor reaching a first predetermined resistance;

upon the resistor reaching said first predetermined resistance, making a trim cut in said resistive film layer commencing contiguously with such terminated at least one plunge cut and progressing therefrom in a direction parallel to such lateral edges of said resistive layer at a first distance from the one lateral edge at which such terminated plunge cut was started, said first distance being less than the length to which said terminated plunge cut extends into said resistive film layer; and terminating making said trim cut upon said resistor reaching a second predetermined resistance.

4. A method of trimming a film resistor according to claim 3, wherein the plunge cut being made progresses into the resistive layer to a second predetermined distance from the one edge at which it was started without the resistor reaching said first predetermined resistance, the second predetermined distance being greater than the first predetermined distance, said method further comprising:

terminating said plunge cut being made, upon said plunge cut progressing to said second predetermined distance;

determining from the change in the resistance of the resistor due to the plunge cut terminated most recently at said second predetermined distance from the starting edge of the cut whether a subsequent plunge cut will progress into the resistive layer to a distance greater than said first predetermined distance prior to the resistor reaching said first predetermined resistance; and making said subsequent plunge cut upon a determination of such subsequent plunge cut being capable of progressing into the resistive layer to a distance greater than said first predetermined distance prior to the resistor reaching said first predetermined resistance, and making a trim cut in said resistive film layer commencing contiguously with such most recently terminated plunge cut and progressing therefrom in a general direction of such lateral edges until the resistor reaches said second predetermined resistance upon a determination of such subsequent plunge cut progressing into the resistive layer to a distance less than or equal to said first predetermined distance.

5. A method of trimming a film resistor according to claim 4, wherein the second predetermined distance is three-fourths of the width of the resistive layer between the lateral edges thereof and the first predetermined distance is one-half of the width of the resistive layer between its lateral edges.

6. A method of trimming a film resistor according to claim 4, wherein said trim cut has been terminated upon said resistor reaching said second predetermined resistance, the method further comprising:

making a shave cut coextensive with said trim cut and commencing contiguously with said most recently terminated plunge cut at a third distance from the lateral edge at which said most recently terminated plunge cut started, said third distance being greater than said first distance and less than the distance to which said most recently terminated plunge cut progressed into the resistive layer.

7. A film resistor, which comprises:

a resistive film layer supported on an insulating substrate, the lateral extent of such layer being bounded by two spaced lateral edges extending in the general direction of intended current flow through such layer and by two spaced lines substantially perpendicular to such edges, said edges and said spaced lines bounding and defining a substantially rectangular adjustment area;

at least one plunge cut extending from one of the lateral edges and toward the other to a first distance into the resistive layer within the adjustment area, said cut causing the layer to become electrically discontinuous across the width of said cut, said first distance being less than a spacing between such lateral edges and greater than a second distance; and a trim cut extending from a lateral edge of the plunge cut adjacent said adjustment area, said trim cut extending into such significant portion substantially parallel to such edges toward said one of the spaced lines and at said second distance from the one lateral edge from which said plunge cut extends the entire length of said trim cut bounding an area of intended current flow defined by said trim cut, a portion of the plunge cut between said first and second distances, and the other of the spaced edges opposite to the one from which the plunge cut extends.

8. A film resistor according to claim 7, wherein the trim cut is widened by a shave cut located coextensively to and laterally offset from the trim cut and extending from said plunge cut adjacent to said one of the spaced lines at a distance greater than said second distance and less than said first distance from said one lateral edge from which said plunge cut extends.

* * * * *

UNITED STATES PATENT AND TRADEMARK OFFICE

CERTIFICATE OF CORRECTION

PATENT NO. : 4,429,298

DATED : January 31, 1984

INVENTOR(S) : D. J. Oberholzer

It is certified that error appears in the above—identified patent and that said Letters Patent is hereby corrected as shown below:

Column 3, line 42, "resistance plunge cut increases as the depth of the increases," should read --resistance increases as the depth of the plunge cut increases,--. In the claims, Column 12, claim 7, line 24, delete "said adjustment area, said trim cut extending into such significant portion" and insert therefor --to one of the spaced lines--.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*